United States Patent [19]

Canter

[11] Patent Number: 4,646,921

[45] Date of Patent: Mar. 3, 1987

[54] PACKAGING AND DISPLAY CONTAINER

[75] Inventor: Stanton J. Canter, Carversville, Pa.

[73] Assignee: Diversified Group, Inc., Telford, Pa.

[21] Appl. No.: 761,368

[22] Filed: Aug. 1, 1985

[51] Int. Cl.[4] ..... A47F 3/14

[52] U.S. Cl. ..... 211/126; 220/23.8; 211/133

[58] Field of Search ..... 211/126, 181, 133, 71, 211/88, 106, 189; 206/558; 220/23.8, 19

[56] References Cited

U.S. PATENT DOCUMENTS

| | | | |
|---|---|---|---|
| 1,739,895 | 12/1929 | Gamble | 211/126 X |
| 1,780,422 | 11/1930 | Geiler | 220/23.8 X |
| 2,257,536 | 9/1941 | Roycroft | 248/126 |
| 2,320,388 | 6/1943 | Shaw | 211/126 X |
| 3,386,608 | 6/1968 | Diller | 220/23.8 X |
| 3,997,060 | 12/1976 | Kunin | 211/137 X |
| 4,036,401 | 7/1977 | Nachtigall, Jr. | 211/133 X |
| 4,069,941 | 1/1978 | Popplewel | 211/126 X |
| 4,109,797 | 8/1978 | Brunette | 211/126 |

FOREIGN PATENT DOCUMENTS

| | | | |
|---|---|---|---|
| 931758 | 2/1947 | France | 211/133 |
| 1392947 | 12/1965 | France | 220/23.8 |
| 654493 | 6/1963 | Italy | 211/126 |
| 6409741 | 3/1965 | Netherlands | 220/23.8 |
| 555616 | 2/1943 | United Kingdom | 211/126 |
| 633323 | 2/1949 | United Kingdom . | |

*Primary Examiner*—J. Franklin Foss
*Assistant Examiner*—Saraah A. Lechok Eley
*Attorney, Agent, or Firm*—Benasutti & Murray

[57] ABSTRACT

A packaging and display container, adapted to removably mate with a wire display rack, comprises at least two adjacent pockets which are separated by a borderline. Each pocket has a bottom, side walls, a front wall and a rear wall. A horizontal flange extends outwardly from and joins the tops of the front walls of the adjacent pockets. A vertical flange extends downwardly from the horizontal flange and may be used to display advertising information relating to articles which are displayed in the container. An aperture is disposed in the horizontal flange in proximity to the juncture of the adjacent pockets and in communication with the borderline between them. The container, with the articles disposed in the pockets, is inserted into the wire support rack by bending the container along the horizontal flange which causes the adjoining pockets to temporarily separate. The container is then slipped into the wire support rack with the apertures surrounding upright portions of wire separators which form compartments in the rack.

10 Claims, 5 Drawing Figures

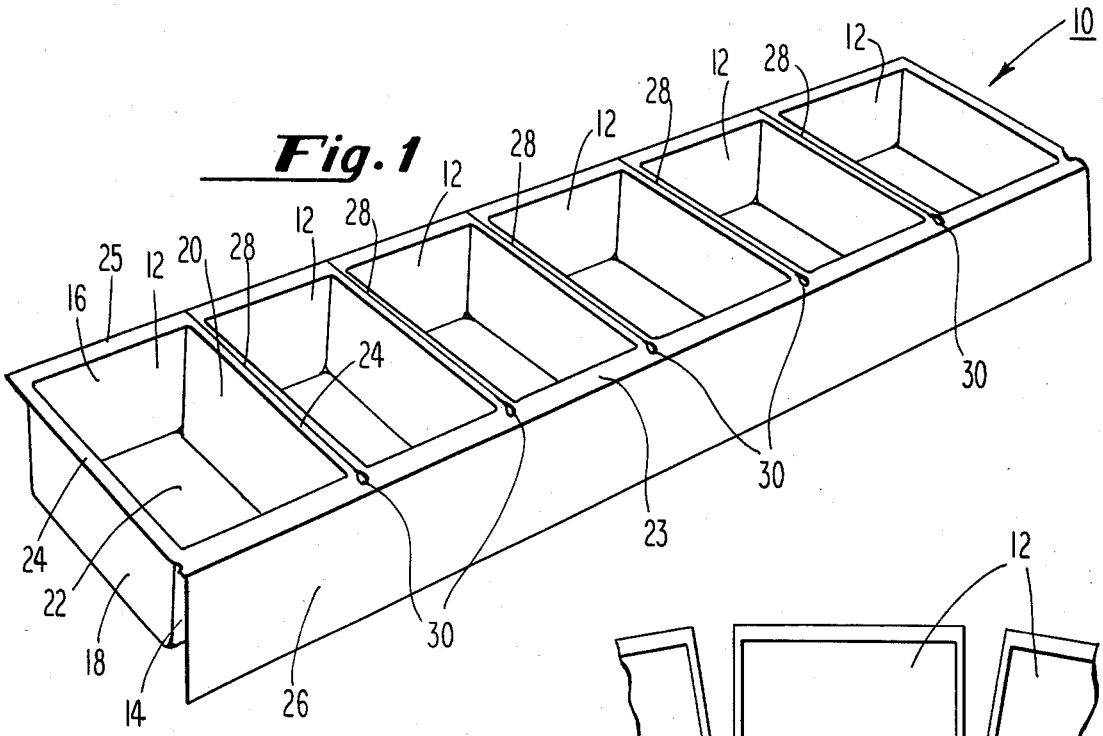
Fig. 1
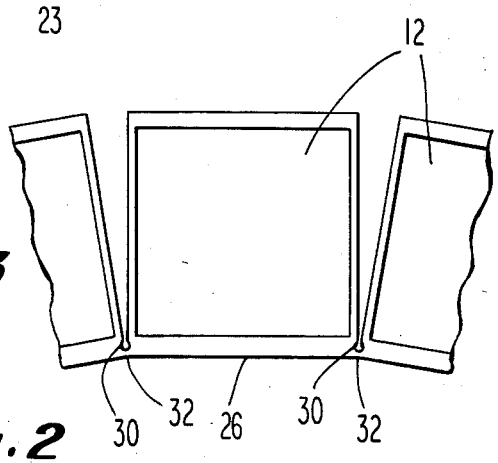
Fig. 3
Fig. 2
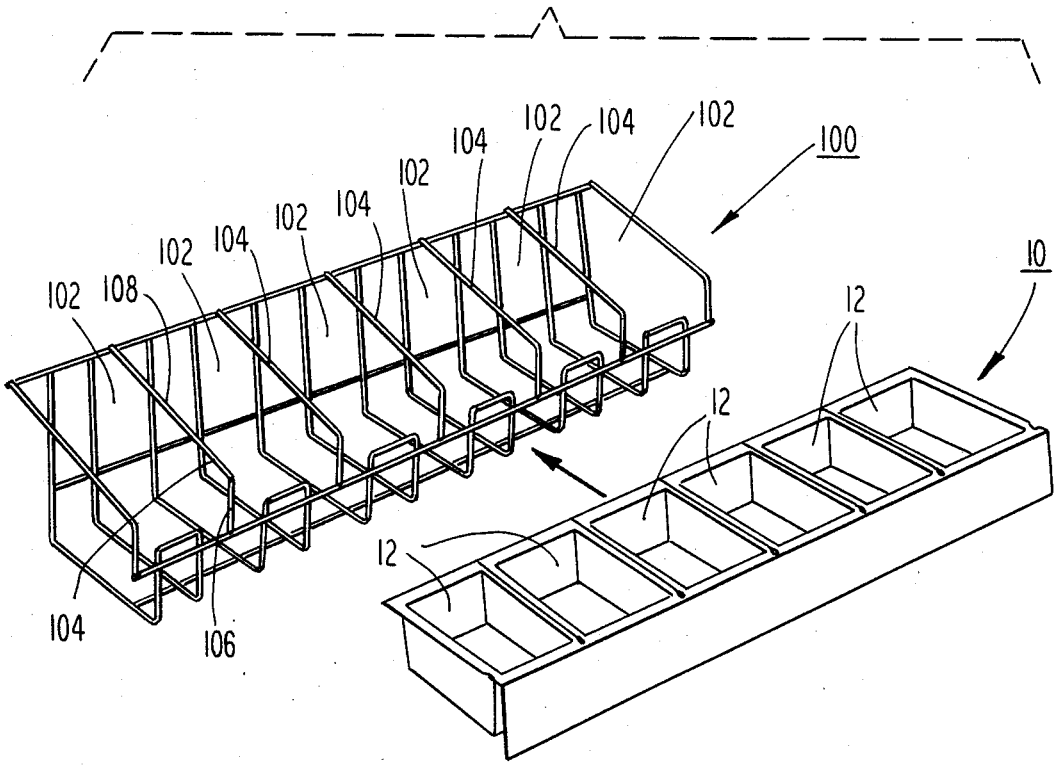

PACKAGING AND DISPLAY CONTAINER

BACKGROUND OF THE INVENTION

This invention relates to containers and more particularly to containers usable for packaging articles prior to shipment as well as for displaying the articles at a point of sale.

Display stands are commonly used to display articles such as magazines and books at the point of sale. Some display stands take the form of wire racks comprising stiff wire elements which are formed into storage compartments. The wire racks are then placed at a desired location and the magazines and books are inserted into the compartments for storage and display. At the end of a predetermined time interval, for example, when subsequent editions of the books are published, the old books are removed from the storage compartments in the rack and the new editions are inserted into their place. This procedure is repeated each time it is desired to replace the old with the new.

Although the aforementioned wire racks serve their basic function of storing and displaying the books, such wire racks present a very unattractive appearance. As is well known in the point of sale display art, a pleasant and attractive appearance is important in inducing customers to purchase the displayed articles. Furthermore, it is time consuming and cumbersome to remove the old books and replace then with new books; the traditional procedure being to simply grab as many as possible by hand and remove them from the rack. This procedure is repeated until the rack is empty. The new magazines are likewise inserted piecemeal into the storage compartments of the rack.

In addition to the cumbersome and time consuming nature of the handling required at the point of sale and the unattractive appearance presented to potential customers, the wire racks are either not equipped to display advertising, sales or other promotional information; or if so equipped, such displays are permanent and are difficult, if not impossible, to update or otherwise modify. This is a serious drawback if the rack is used to display ever changing merchandise such as books since updating the displayed information to reflect the latest issue can not be easily accomplished or may not even be possible at all.

SUMMARY OF THE INVENTION

Accordingly, it is an object of the present invention to provide a packaging and display container which enables a reduction in the handling of the articles to be displayed at the point of sale.

It is a further object of the present invention to provide a packaging and display container which presents an attractive appearance to consumers.

It is a further object of the present invention to provide a packaging and display container in which the articles to be displayed can be stored during shipment.

It is still another object of the present invention to provide a packaging and display container which includes space for incorporating legends such as advertising and sales information.

Briefly described, the present invention comprises a storage and display container adapted to removably mate with a support frame. The container comprises at least two adjacent pockets separated by a borderline therebetween, each pocket having a bottom, side walls and end walls. A horizontal flange extends outwardly from and joins the tops of a first one of the end walls of the adjacent pockets. An aperture is disposed in the horizontal flange in proximity to the juncture of the adjacent pockets and in communication with the borderline therebetween.

The foregoing and other objects, features and advantages of the invention, as well as presently preferred embodiments thereof, will become more apparent from a reading of the following description in conjunction with the accompanying drawing.

BRIEF DESCRIPTION OF THE DRAWINGS

FIG. 1 is a perspective view of a preferred embodiment of a packaging and display container in accordance with the present invention.

FIG. 2 is a perspective view of a preferred embodiment of the packaging and display container depicted in FIG. 1 as well as a perspective view of one form of wire display rack prior to the insertion of the packaging and display container thereon.

FIG. 3 is a partial plan view of a preferred embodiment of the packaging and display container of the present invention showing adjacent pockets which are spread apart from each other.

DESCRIPTION OF THE PREFERRED EMBODIMENT

Figure 4:
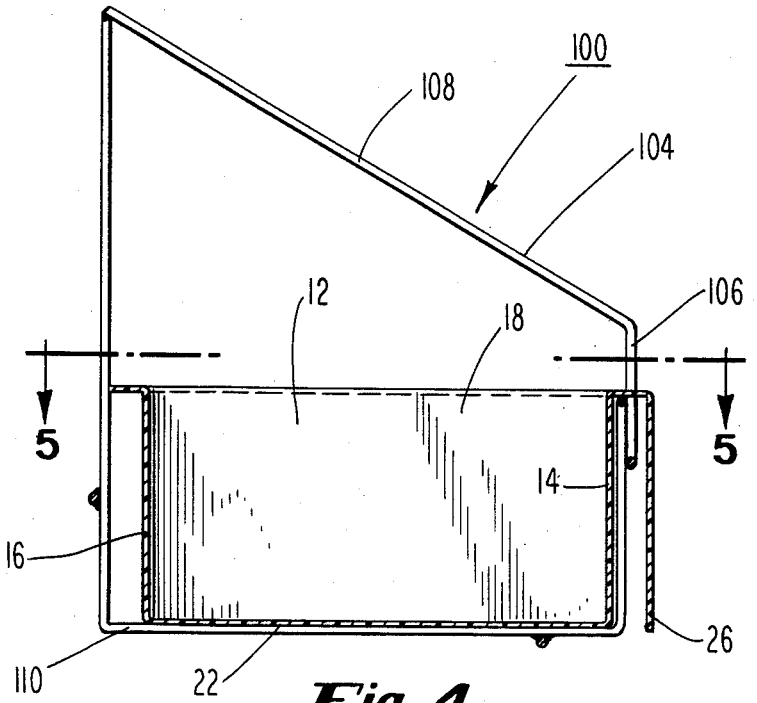
FIG. 4 is a cross-sectional side view of a packaging and display container inserted into a wire display rack in accordance with the present invention.

Referring to FIG. 1, there is shown a perspective view of a preferred embodiment of a packaging and display container in accordance with the present invention, generally designated 10. The container 10 includes at least two pockets 12. In the embodiment shown in FIG. 1, there are six pockets 12 illustrated. The number of pockets 12 included in each container 10 depends upon the number of storage compartments in the supporting wire rack as will be hereinafter described. Each pocket 12 comprises a pair of end walls consisting of a front wall 14 and a rear wall 16; a pair of side walls consisting of a first side wall 18 and a second side wall 20; and a bottom 22. A horizontal flange 23 extends outwardly from and joins the tops of the front walls 14 of the pockets 12. In the embodiment depicted in FIG. 1, each pocket 12 also includes a second horizontal flange 24 which extends outwardly from the tops of the first 18 and second 20 side walls of each pocket 12. In addition, a third horizontal flange 25 extends outwardly from the top of the rear wall 16. It should be noted that the second 24 and third 25 horizontal flanges are preferred but not essential features of the container 10. A vertical flange 26 extends downwardly from the front edge of the horizontal flange 23. A borderline 28 is defined by adjacent second horizontal flanges 24. Where the second horizontal flanges 24 are not utilized, the borderline 28 is defined by adjacent side walls 18.

It is preferred that the entire container be constructed of a material having sufficient strength to support the articles to be packaged and contained therein. A preferred material is plastic, such as styrene, which can be used to mold or otherwise form the container 10 in a variety of colors, if desired, and to a preferred thickness of approximately 0.060 inch. It should be noted however, that greater or lesser thicknesses could also be satisfactory depending upon the strength characteristics of the material utilized and such other thicknesses and materials are to be considered to be within the scope and contemplation of the present invention. In addition, to exhibiting the strength necessary to support the package and displayed article, the material must also exhibit that degree of flexibility which will will enable the horizontal flange 23 and vertical flange 26 to be flexed in the vicinity of the apertures 30, as the result of applied bending forces in order to temporarily separate the adjacent pockets as hereinafter described, without fracturing. In addition to being flexible, the material must possess sufficient stiffness such that, upon release of the bending forces, the adjacent pockets 12 are returned to their adjacent positions, as also described hereinafter.

Referring now to FIG. 2, there is shown a container 10 about to be inserted into a wire display rack, generally referred to 100. The wire display rack comprises a plurality of wire elements which are formed into a supporting structure containing a plurality of storage compartments 102. In the embodiment depicted, the compartments 102 are separated by a wire separator 104 comprising an upright portion 106 and a top portion 108. The pockets 12 of the container 10 are dimensioned such that they fit inside the compartments 102 of the wire support rack 100. To insert the container 10 into the wire support rack 100, the pockets 12 are spread apart by bending the front flange 26 as shown in FIG. 3. The pockets 12 separate along the borderline 28 by pivoting about flexure regions 32 which are located in the vicinity of the apertures 30.

The adjacent pockets 12 are spread apart by an amount sufficient to create a clearance between the adjacent pockets 12 of the container 10 and the top portion 108 of the wire separators 104. The container 10 is then lowered into the wire support rack 100 with the upright portions 106 of each wire separator 104 disposed within a mating aperture 30.

Figure 5:
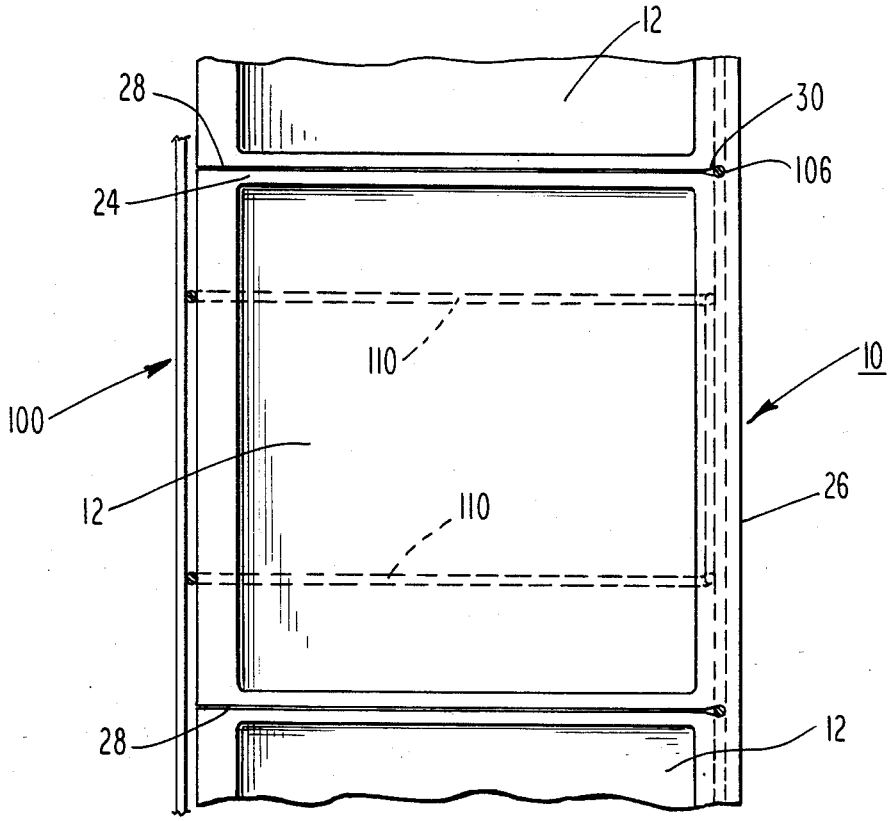
FIG. 5 is a sectional view taken along lines 5-5 of FIG. 4.

FIGS. 4 and 5 depict the container inserted into the wire support rack 100. As can be seen in these figures, the bottoms 22 of the pockets 12 of the container 10 rest upon wire support elements 110. The upright portions 106 of the wire separators 104 are disposed within the apertures 30 of the container 10. As previously stated, the stiffness of the front flange 26 and the flexure regions 32 cause the pockets 12 to be biased adjacent to each other as shown in FIG. 5 upon removal of the bending force. To remove the container 10 from the wire support rack 100, the adjacent pockets 12 are spread apart along the borderlines 28 as previously described. The adjacent pockets are spread apart sufficiently to clear the upper portion 108 of the wire separators 104 thereby enabling the container 10 to be removed from the wire support rack 100. The insertion and removal procedure is preferably performed with the articles already disposed within the pockets 12. It is preferred that the supplier of the articles ship them to the point of sale already positioned within the pockets 12 of the container 10. In this way, the prior articles are all removed at one time by removing the container 10 and the replacement articles are replaced all at one time since have already been inserted into the pockets 12 of the container 10 by the shipper.

The vertical flange 26 may be utilized to display legends containing advertising and sales information or any other type of information, as well as decoration or ornamentation designed to attract and inform buyers regarding the articles stored and displayed within the container 10. This information can be molded into the flange 26 of the container 10 at the time it is made, or can be applied after the manufacture of the container by means of preprinted adhesive labels and the like.

As can be seen from the above detailed description, the packaging and display container of the present invention enables the creation of an attractive display of articles to be sold by providing a storage and display container which can be molded of materials in inviting colors and which can incorporate alluring designs or other ornamental features as well as descriptive, marketing and/or sales information all of which is designed to encourage the consumer to purchase the articles stored therein. In addition, the container of the present invention reduces handling required to replace articles to be displayed by enabling the user to remove the container and all of its stored articles at one time and to replace these articles with new articles which have been prepacked into the container and therefore are insertable into the display rack all at one time.

While the principles of the invention have now been made clear in an illustrative embodiment, there will be apparent to those skilled in the art, many modifications of structures, arrangements, elements, materials and components used in the practice of the invention and otherwise, which are particularly adapted for specific environments and operating requirements without departing from those principles. The appended claims are, therefore, intended to cover and embrace any such modifications within the limits only of the true spirit and scope of the invention.

I claim:

1. A packaging and display container adapted to removably mate with a support rack comprising a plurality of wire elements formed into a supporting structure, said support rack being divided into at least two compartments separated by a wire separator having an upright portion, said container comprising:

(a) at least two adjacent pockets separated by a borderline therebetween, each pocket having a bottom, side walls and end walls;

(b) a horizontal flange connecting said adjacent pockets, said horizontal flange extending outwardly from the tops of a first one of said end walls of said adjacent pockets; and (c) an aperture in said horizontal flange in proximity to the juncture of said adjacent pockets and in communication with said borderline therebetween, whereby said adjacent pockets are separable at one end of the borderline in order to admit said upright portion of said wire separator into mating engagement within said aperture.

2. A packaging and display container in accordance with claim 1 additionally comprising a vertical flange extending downwardly from said horizontal flange.

3. A packaging and display container in accordance with claim 2 additionally comprising a second horizontal flange extending outwardly from the top of each side wall.

4. A packaging and display container in accordance with claim 3 additionally comprising a third horizontal flange extending outwardly from the top of a second one of said end walls.

5. A packaging and display container adapted to removably mate with a support rack comprising a plurality of wire elements formed into a supporting structure, said support rack being divided into at least two compartments separated by a wire separator having an upright portion, said container comprising:

(a) at least two adjacent pockets separated by a borderline therebetween, each pocket having bottom, side walls and end walls;

(b) a horizontal flange connecting said adjacent pockets, said horizontal flange extending outwardly from the tops of a first one of said end walls of said adjacent pockets;

(c) a vertical flange extending downwardly from said horizontal flange; and (d) an aperture disposed in said horizontal flange in proximity to the juncture of said adjacent pockets and in communication with said borderline therebetween, said vertical flange and said aperture cooperating to form hinge means for biasing said adjacent pockets in abutting relationship and enabling said adjacent pockets to be spread apart at the end of the borderline opposite said aperture in order to admit said upright portion of said wire separator into mating engagement within said aperture.

6. A packaging and display container in accordance with claim 5 additionally comprising a second horizontal flange extending outwardly from the top of each side wall and a third horizontal flange extending outwardly from the top of the rear wall.

7. In combination with a support rack comprising a plurality of wire elements formed into a supporting structure, said support rack being divided into at least two compartments separated by a wire separator having an upright portion, a packaging and display container comprising:

(a) at least two adjacent pockets separated by a borderline therebetween and positioned in respective compartments of said support rack, each pocket having a bottom, side walls, and end walls;

(b) a horizontal flange connecting said adjacent pockets, said horizontal flange extending outwardly from the tops of a first one of said end walls of said adjacent pockets; and (c) an aperture disposed in said horizontal flange in proximity to the juncture of said adjacent pockets and in communication with said borderline therebetween, said aperture surrounding said upright portion of said wire separator.

8. The combination in accordance with claim 7 wherein said packaging and display container additionally comprises a vertical flange extending downwardly from said horizontal flange.

9. The combination in accordance with claim 8 wherein said packaging and display container additionally comprises a second horizontal flange extending outwardly from the top of each side wall.

10. The combination in accordance with claim 9 wherein said packaging and display container additionally comprises a third horizontal flange extending outwardly from the top of the second one of said end walls.

* * * * *